US009383164B2

(12) United States Patent
Langevin et al.

(10) Patent No.: US 9,383,164 B2
(45) Date of Patent: Jul. 5, 2016

(54) MODULAR UPPER RECEIVER AND FIREARM WITH MODULAR UPPER RECEIVER

(71) Applicants: Kevin Richard Langevin, Berlin, CT (US); Eric Talasco, North Granby, CT (US)

(72) Inventors: Kevin Richard Langevin, Berlin, CT (US); Eric Talasco, North Granby, CT (US)

(73) Assignee: COLT'S MANUFACTURING IP HOLDING COMPANY LLC, West Hartford, CT (US)

( * ) Notice: Subject to any disclaimer, the term of this patent is extended or adjusted under 35 U.S.C. 154(b) by 0 days.

(21) Appl. No.: 13/738,208

(22) Filed: Jan. 10, 2013

(65) Prior Publication Data

US 2014/0075804 A1 Mar. 20, 2014

Related U.S. Application Data

(60) Provisional application No. 61/586,477, filed on Jan. 13, 2012.

(51) Int. Cl.

| | |
|---|---|
| ***F41C 27/00*** | (2006.01) |
| ***F41A 3/66*** | (2006.01) |
| ***F41C 23/16*** | (2006.01) |
| *F41G 11/00* | (2006.01) |

(52) U.S. Cl.

CPC . *F41C 27/00* (2013.01); *F41A 3/66* (2013.01); *F41C 23/16* (2013.01); *F41G 11/003* (2013.01); *Y10T 29/49826* (2015.01)

(58) Field of Classification Search

CPC ..... F41C 23/16; F41C 27/00; F41A 3/66; F41G 11/003; Y10T 29/49826

USPC ..... 42/71.01, 72, 73, 96; 89/14.1

See application file for complete search history.

(56) References Cited

U.S. PATENT DOCUMENTS

| | | | | |
|---|---|---|---|---|
| 5,198,600 | A * | 3/1993 | E'Nama | 42/90 |
| 5,590,484 | A * | 1/1997 | Mooney et al. | 42/111 |
| 5,726,377 | A | 3/1998 | Harris et al. | |
| 6,792,711 | B2 | 9/2004 | Battaglia | |
| 7,131,228 | B2 | 11/2006 | Hochstrate et al. | |
| 7,775,150 | B2 | 8/2010 | Hochstrate et al. | |
| 8,087,194 | B1 | 1/2012 | Vuksanovich | |
| 8,201,353 | B1 * | 6/2012 | Swan | 42/71.01 |

(Continued)

FOREIGN PATENT DOCUMENTS

| | | |
|---|---|---|
| RU | 61404 U1 | 2/2007 |
| RU | 64337 U1 | 6/2007 |
| WO | 2010111026 A1 | 9/2010 |

OTHER PUBLICATIONS

International Search Report dated Oct. 16, 2014 for International Application No. PCT/US2013/020991.

(Continued)

*Primary Examiner* — Bret Hayes
(74) *Attorney, Agent, or Firm* — Cantor Colburn LLP

(57) ABSTRACT

A modular rail system for an upper receiver of a firearm is provided, the modular rail system having: a bottom portion configured to be removably secured to the upper receiver, wherein the bottom portion has an integrally formed bottom rail and a forward portion located forward of a top rail of the upper receiver; an upper rail extension configured to be removably secured to the forward portion of the bottom portion; and a release mechanism for releasably securing the upper portion to the forward portion of the bottom portion.

20 Claims, 13 Drawing Sheets

(56) References Cited

U.S. PATENT DOCUMENTS

| | | | | |
|---|---|---|---|---|
| 8,240,074 | B2 | 8/2012 | Vuksanovich | |
| 2007/0199435 | A1 | 8/2007 | Hochstrate et al. | |
| 2008/0092422 | A1* | 4/2008 | Daniel et al. | 42/90 |
| 2009/0038198 | A1* | 2/2009 | Yu | 42/90 |
| 2010/0126054 | A1* | 5/2010 | Daniel et al. | 42/71.01 |
| 2010/0186278 | A1* | 7/2010 | Daniel | 42/71.01 |
| 2010/0192444 | A1* | 8/2010 | Cabahug et al. | 42/71.02 |
| 2010/0212201 | A1* | 8/2010 | Kincel et al. | 42/2 |
| 2011/0239513 | A1 | 10/2011 | Sandman | |
| 2012/0017483 | A1 | 1/2012 | Vuksanovich | |
| 2012/0036756 | A1* | 2/2012 | Brown | 42/71.01 |
| 2012/0090150 | A1 | 4/2012 | Vuksanovich | |
| 2012/0297970 | A1 | 11/2012 | Langevin et al. | |
| 2012/0317860 | A1 | 12/2012 | Langevin et al. | |
| 2012/0324775 | A1* | 12/2012 | Troy et al. | 42/71.01 |
| 2013/0174721 | A1 | 7/2013 | Langevin et al. | |

OTHER PUBLICATIONS

Written Opinion dated Oct. 16, 2014 for International Application No. PCT/US2013/020991.

Supplementary European Search Report for Application No. 13736241.4: Dated: Sep. 9, 2015.

* cited by examiner

MODULAR UPPER RECEIVER AND FIREARM WITH MODULAR UPPER RECEIVER

CROSS REFERENCE TO RELATED APPLICATIONS

This application claims the benefit of U.S. Provisional Patent Application Ser. No. 61/586,477 filed Jan. 13, 2012, the contents of which are incorporated herein by reference thereto.

BACKGROUND

Various embodiments of the present invention relate generally to an apparatus and method for providing a modular upper receiver and more particularly, a modular upper receiver with an extended rail.

Numerous accessories are mounted on a standard firearm rail by engaging features of the rail, non-limiting examples of such features include but are not limited to telescopic sights, tactical sights, laser sighting modules, Global Positioning Systems (GPS) and night vision scopes. Standard firearm rails include a military standard 1913 rail, Weaver rail, NATO STANAG 4694 accessory rail or equivalents thereof. In addition and depending upon the type of weapon as well as the user it is desirable to provide rails of varying lengths.

Accordingly, it is desirable to provide a modular upper receiver wherein various configurations of the rail can be provided. Still further, it is desirable to provide a free floating modular one piece upper that can be adapted to various length barrel configurations and thus provide hand mounts configured for the barrel length of the weapon.

SUMMARY OF THE INVENTION

In one exemplary embodiment, a modular rail system for an upper receiver of a firearm is provided, the modular rail system having: a bottom portion configured to be removably secured to the upper receiver, wherein the bottom portion has an integrally formed bottom rail and a forward portion located forward of a top rail of the upper receiver; an upper rail extension configured to be removably secured to the forward portion of the bottom portion; and a release mechanism for releasably securing the upper portion to the forward portion of the bottom portion.

In another embodiment an upper receiver for a weapon is provided, the upper receiver having: a bottom portion configured to be removably secured to the upper receiver, wherein the bottom portion has a forward portion located forward of a top rail of the upper receiver; an upper portion configured to be removably secured to the forward portion of the bottom portion; and a release mechanism for releasably securing the upper portion to the forward portion of the bottom portion.

In still another embodiment a firearm is provided, firearm having: an upper receiver; a bottom portion configured to be removably secured to the upper receiver, wherein the bottom portion has a forward portion located forward of a top rail of the upper receiver; an upper portion configured to be removably secured to the forward portion of the bottom portion; and a release mechanism for releasably securing the upper portion to the forward portion of the bottom portion.

In yet another embodiment, a method of securing a rail extension to an upper receiver of a weapon is provided, the method including the steps of: removably securing a bottom portion to the upper receiver, wherein the bottom portion has a forward portion located forward of a top rail of the upper receiver when the bottom portion is secured to the upper receiver; and removably securing an upper portion to the forward portion of the bottom portion, wherein the upper portion extends forward an upper rail of the upper receiver Other aspects and features of embodiments of the invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached Figures, wherein.

DETAILED DESCRIPTION

Reference is made to the following U.S. Pat. Nos. 6,792,711; 7,131,228; and 7,775,150 the contents each of which are incorporated herein by reference thereto. Reference is also made to the following pending U.S. Provisional Patent Application Ser. No. 61/481,697, filed May 2, 2011 and U.S. Provisional Patent Application Ser. No. 61/498,226, filed Jun. 17, 2011, the contents each of which is incorporated herein by reference thereto.

Disclosed herein is an apparatus, method and system for providing a modular rail for a weapon or firearm to provide various options and configurations for the rail system of an upper receiver of a firearm. The rail system allows for mounting of various accessories such as: telescopic sights, tactical sights, laser sighting modules, illumination devices, and vision enhancing devices, Global Positioning Systems (GPS), night vision scopes and grenade launchers to the weapon. This list is not meant to be exclusive, merely an example of accessories that may utilize a modular rail.

Figure 10:
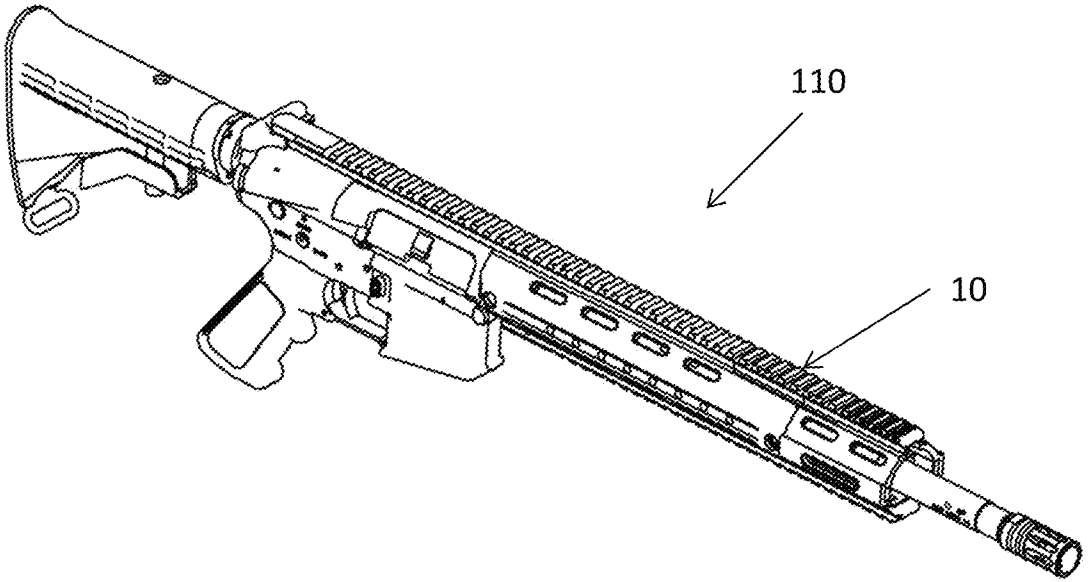
FIG. 10 illustrates a non-limiting firearm or rifle according to various embodiments of the present invention.

Referring now to FIGS. 1-6, an upper receiver 10 with a modular rail or modular rail system 12 according to one embodiment is illustrated. The modular rail system 12 further comprises at least a portion of a hand guard 14 of the upper receiver 10. In various non-limiting embodiments the upper receiver is configured for use with a firearm or rifle that may be anyone of gas operated, piston or hybrid, non-limiting examples include the M-4 or M-16 type or similar commercial variants thereof as well as other types of firearms described in above mentioned patents as well as U.S. Pat. No. 5,726,377, the contents of which are also incorporated herein by reference thereto. FIG. 10 illustrates a non-limiting rifle or firearm 110 having an upper receiver 10 according to one of the various embodiments of the present invention.

In accordance with an exemplary embodiment of the present invention, at least a portion of the modular rail system 12 and a portion of the upper receiver 10 is configured with at least one integral rail such as a "Piccatiny Rail" configuration as described in Military Standard 1913 (MIL-STD-1913 (AR)), which is hereby incorporated by reference herein in its entirety. Other rails can also be removably secured to the upper receiver to provide numerous mounting configurations. Of course, other rail configurations are configured to be within the scope of various embodiments of the present invention. The modular rail system 12 and upper receiver 10 including the integral rails may be made from any suitable material such as hard coat anodized aluminum as an example.

As illustrated, the upper receiver 10 has integrally formed therewith an upper rail 16 and a pair of side rails 18 located on either side of the upper receiver 10. In one embodiment, the side rails 18 may be similar to those disclosed in Ser. No. 61/481,697, filed May 2, 2011. As illustrated, the modular rail system 12 is provided for removable securement to the upper receiver 10. The modular rail system 12 has a removable bottom portion or removable bottom hand guard portion 20. The removable bottom portion 20 also has an integrally formed the bottom rail 22. In addition, the modular rail system 12 further comprises an upper rail extension, upper rail portion or upper portion 24 that is removably secured to a forward portion 26 of the removable bottom portion 20.

In addition, the upper rail extension or upper rail portion 24 further comprises an integrally formed upper rail 28, which when secured to the upper receiver 10 provides a further extension forward of the upper rail of the upper receiver 10. Accordingly and in the assembled state, the upper rail of the upper receiver 10 comprises the combination of the integrally formed upper rail 16 as well as the integrally formed upper rail 28 of the upper rail extension, upper rail portion or upper portion 24. Alternatively, the upper portion 24 can be configured without any rail portion and simply provide an extension of the hand guard 14.

Accordingly, the modular rail system 12 allows for an upper receiver 10 to be configured with a forward extension of the rail system as well as a hand guard of the upper receiver. For example and as illustrated in the attached figures, the forward portion 26 of the bottom portion 20 and the upper rail extension or portion 24 extend forward or past a sight 30 of the upper receiver 10. This forward extension allows a user of the firearm to grasp the firearm via the hand guard comprising the forward portion 26 of the bottom portion 20 and the upper rail extension or portion 24. This allows a user to locate at least one of their hands forward of the sight 30. By allowing an operator of the firearm to locate their hand proximate to the distal or forward end of the upper receiver movement of their hand at this location will cause minimal or less movement of the upper receiver including the sight 30 as well as a barrel 32 such that greater accuracy can be provided as opposed to similar movement of a user's hand at a location of the hand guard further towards the rearward end of the upper receiver 10.

Moreover and by allowing the user to locate their off hand at the furthest possible position (e.g., closest to the muzzle), this will minimize the amount of barrel movement while shooting. Accordingly, the free floating modular one piece upper receiver 10 as disclosed herein, can be adapted to various length barrel configurations in order to provide the furthest possible hand mount for the barrel length of the weapon being used.

In one non-limiting embodiment and in order to removably secure the bottom portion 22 the upper receiver 10, a keyed/key way system or tongue and groove system is employed. Here, the removable bottom portion 22 has a pair of tabs 34 which are inserted into complementary openings 36 of the upper receiver in the direction of arrow 38 (see FIG. 6) until an edge 40 of the bottom portion 20 is adjacent to an edge 42 of the upper receiver 10 and then the bottom portion 20 can be slid in the direction of arrow 40 which at the same time causes another pair of tabs 42 to be slidably received within complimentary openings 44 of the upper receiver 10. Once the bottom portion 20 is slid in the direction of arrow 40 until it is located in the position depicted in at least FIG. 1, the bottom portion 20 is secured to the upper receiver is secured to the upper receiver 10 via fastening means 46 inserted into complementary openings 48, 50 in both the upper receiver and the bottom portion 20. One non-limiting type of fastening means 46 is a screw configured to engage threaded openings 50 in the bottom portion 20. Of course, any other equivalent fastening means is contemplated to be within the scope of exemplary embodiments of the present invention.

In order to remove the bottom portion 20, a user simply removes the fastening means 46 and slides the bottom portion 20 in a direction opposite to arrow 40 until the tabs 34 are in a position to be moved in a direction opposite to arrow 38 and thus allow the bottom portion 20 to be removed from the upper receiver 10.

One alternative means for securing the bottom portion 20 to the upper receiver 10 is a quick release lock lever that is pivotally mounted to the bottom portion 20 and is spring biased to engage a feature of the upper receiver when the bottom portion 20 is secured thereto. Here the lever will be spring biased into a first or engagement position such that a portion of the lever or mechanism associated therewith will engage a feature of the upper receiver when the bottom portion is secured thereto. In order to release the quick lock lever a user accesses the lever through an opening in the bottom portion in order to pivot or move the lever from the first position such that the bottom portion 20 can be disengaged from the upper receiver 10. One non-limiting configuration of such a quick release lock lever is illustrated in at least FIG. 29 of U.S. Pat. No. 7,775,150 the contents of which are incorporated herein by reference thereto. The aforementioned quick release lock lever may be used in lieu of or in combination with fastening means 46.

Upper portion 24 is removably secured to the forward portion 26 of the bottom portion 20 via a spring biased release mechanism 52 or any other type of mechanism or fastening means that allows for removable securement. In one embodiment, the spring biased release mechanism 52 comprises a pair of members 54 pivotally mounted to the bottom portion 20 via a pin 56 such that movement in the direction of arrows 58 is possible. As illustrated in at least FIG. 4, a spring 60 biases an ear portion or portion 70 into a slot, channel or feature 72 of the upper portion 24 such that upper portion 24 is secured to bottom portion 20. In order to remove upper portion 24 from bottom portion 28, a user simply applies a force to a portion of the member 54 remote from ear portion 70 such that the members 54 pivot about pin 56 and ear member 70 is no longer received within slot or channel 72 at the same time a user slides the upper portion 24 in the direction of arrow 76. One non-limiting type of an alternative fastening means is a screw or screws configured to engage threaded openings in the bottom portion. Of course, any other equivalent fastening means or mechanism for removably or releasably securing the upper portion 24 or upper rail extension to the bottom portion and/or upper receiver is contemplated to be within the scope of exemplary embodiments of the present invention.

Upper portion 24 slidably engages the forward portion 26 of bottom portion 20 via a pair of channels 78 in upper portion 24 that are configured to slidably engage forward tab members 79 of the bottom portion 20 as well as a portion of tabs 42. In order to secure upper portion 24 to the forward portion 26 of the bottom portion 28, a user depresses members 54 such that upper portion 24 can slide by ear portions 70 in a direction opposite to arrow 76 until slots 72 are aligned with ear portion 70 and the same snap into place within slots 72 via the biasing force of spring 60. Accordingly, upper portion 24 is removably secured to the forward portion 26 of bottom portion 20 as well as the upper receiver 10.

As mentioned above, the forward portion 26 and upper portion 24 of the modular rail system 12 allows for extended rails as well as a hand guard to be positioned forward of the sight 30 of the upper receiver 10. Still further and since upper portion 24 is removably secured to the forward portion 26 of the bottom portion 20 various configurations of the modular rail system 12 are capable of being provided.

For example and in the embodiment illustrated in FIGS. 1-6, upper portion 24 is configured with a gap or opening 80 at a rearward end of the upper portion 24. Accordingly and once this upper portion 24 is secured to the forward portion 26 opening 80 provides access to a forward end of the sight 30 which is particularly useful in piston operated firearm systems wherein adjustment and/or removal of a piston sleeve from a gas block 82 is required.

Figure 1:
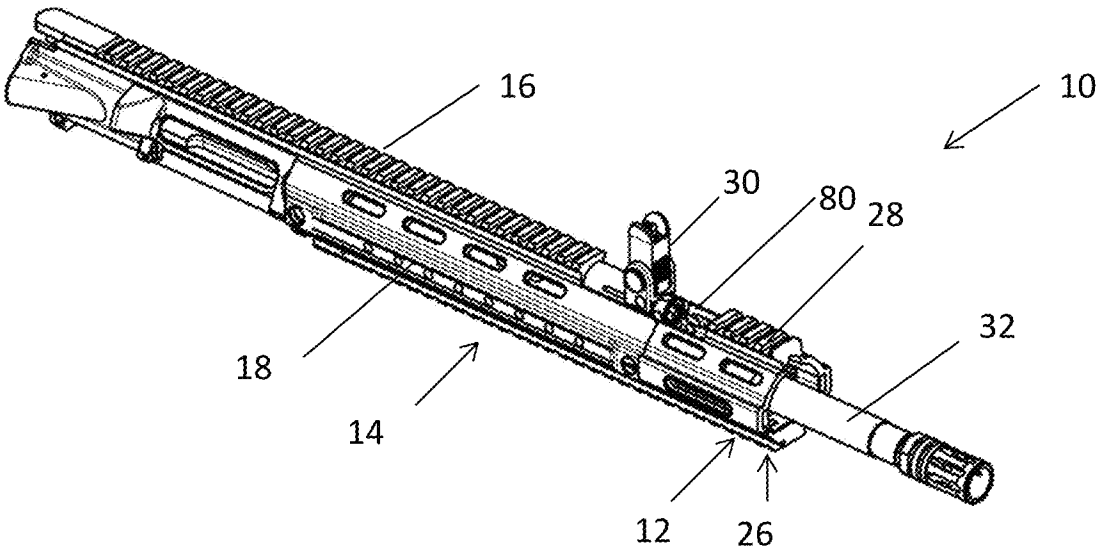
FIG. 1 is a perspective view of an upper receiver with a modular rail assembly in accordance with an exemplary embodiment of the present invention.
Figure 2:
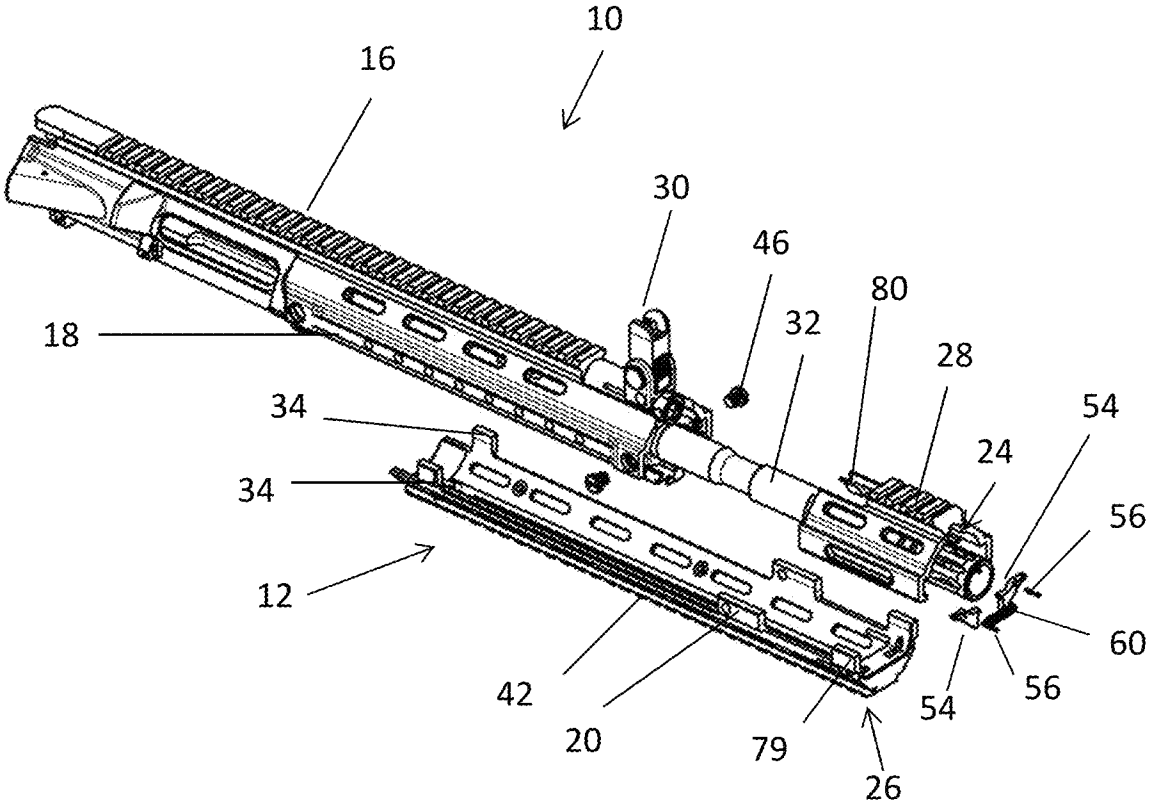
FIG. 2 is an exploded perspective view of the upper receiver and modular rail assembly of FIG. 1.
Figures 3, 4:
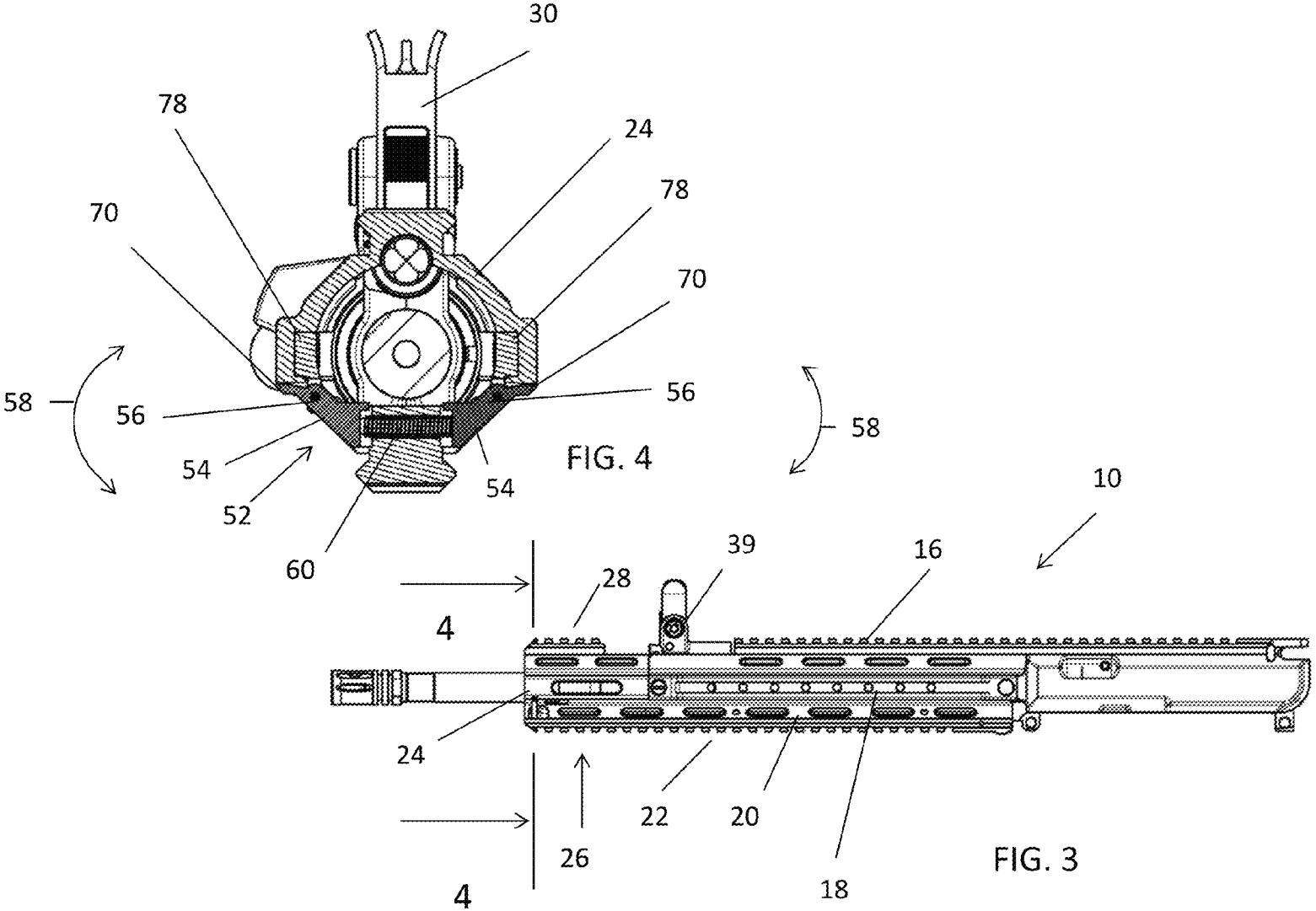
FIG. 3 is a side view of the upper receiver and modular rail assembly of FIG. 1.
FIG. 4 is a view along lines 4-4 of FIG. 3.
Figure 5:
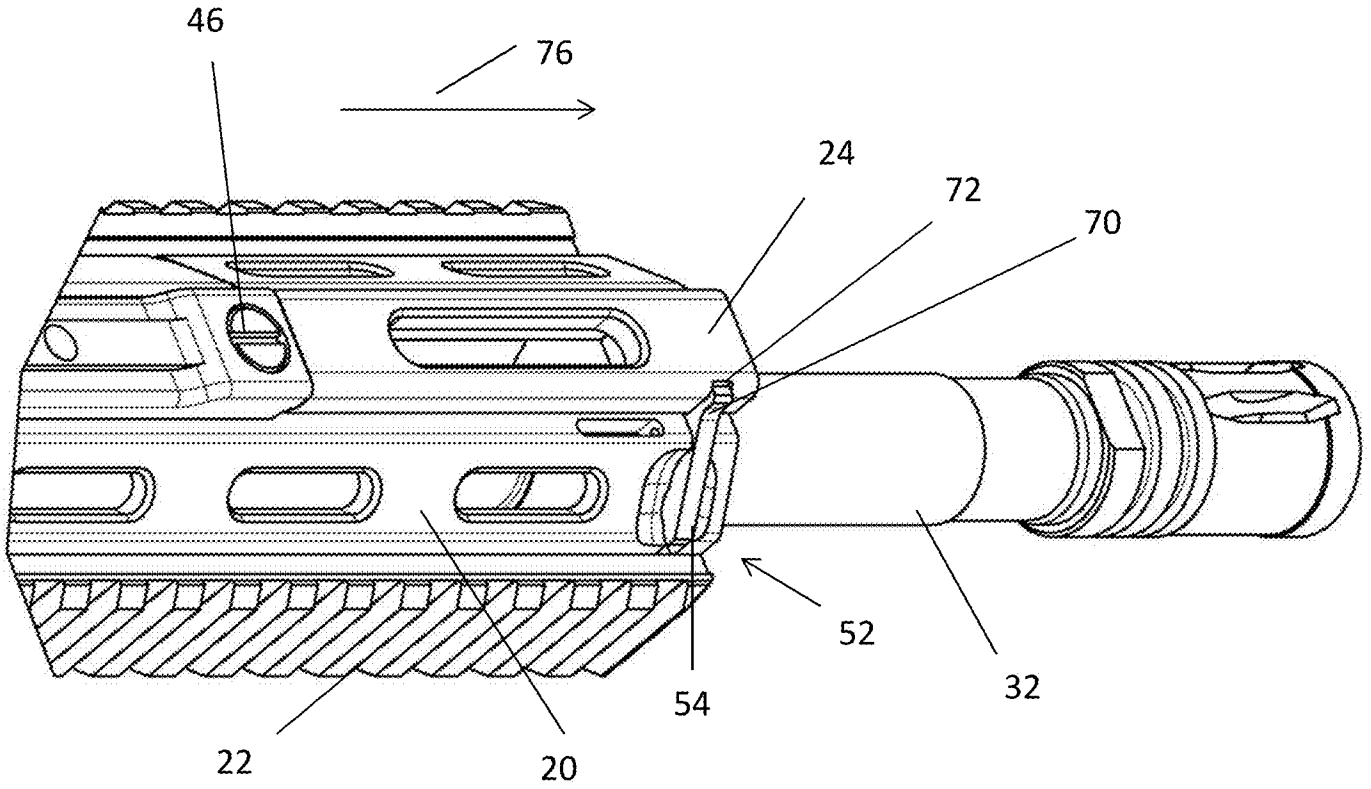
FIG. 5 is an enlarged view of a portion of FIG. 1.
Figure 6:
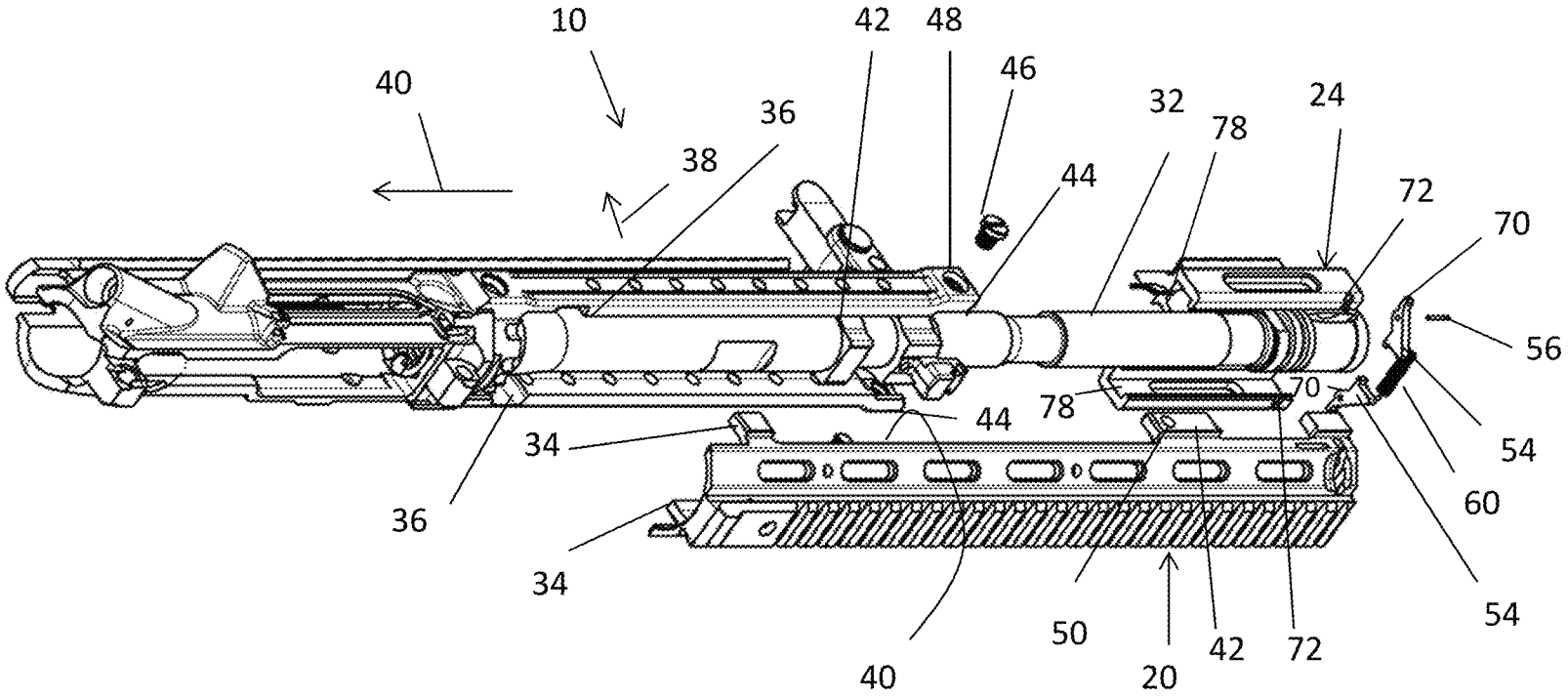
FIG. 6 is another exploded perspective view of the upper receiver and modular rail assembly of FIG. 1.
Figure 7A:
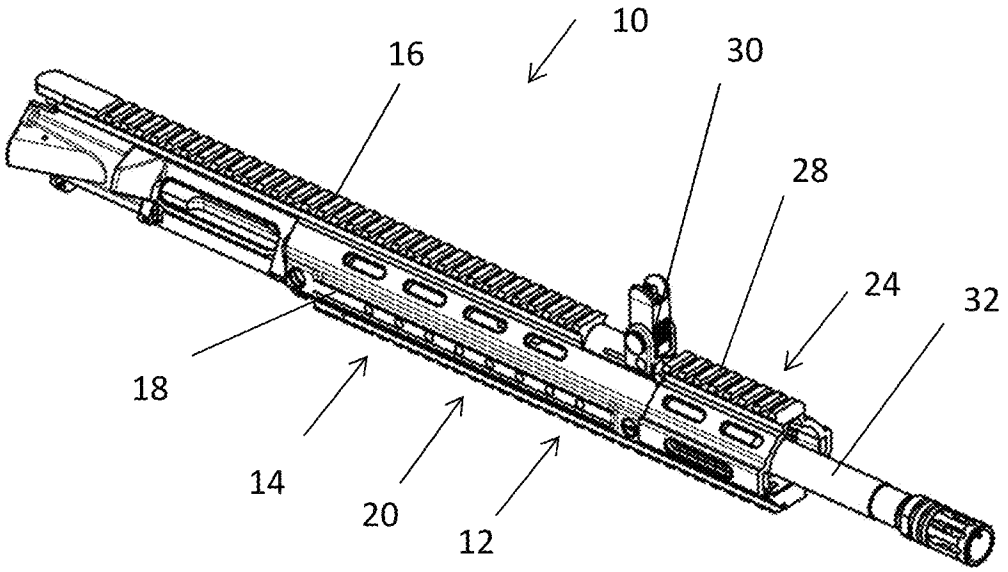
FIG. 7A is a perspective view of an upper receiver and modular rail assembly in accordance with an alternative embodiment.
Figure 7B:
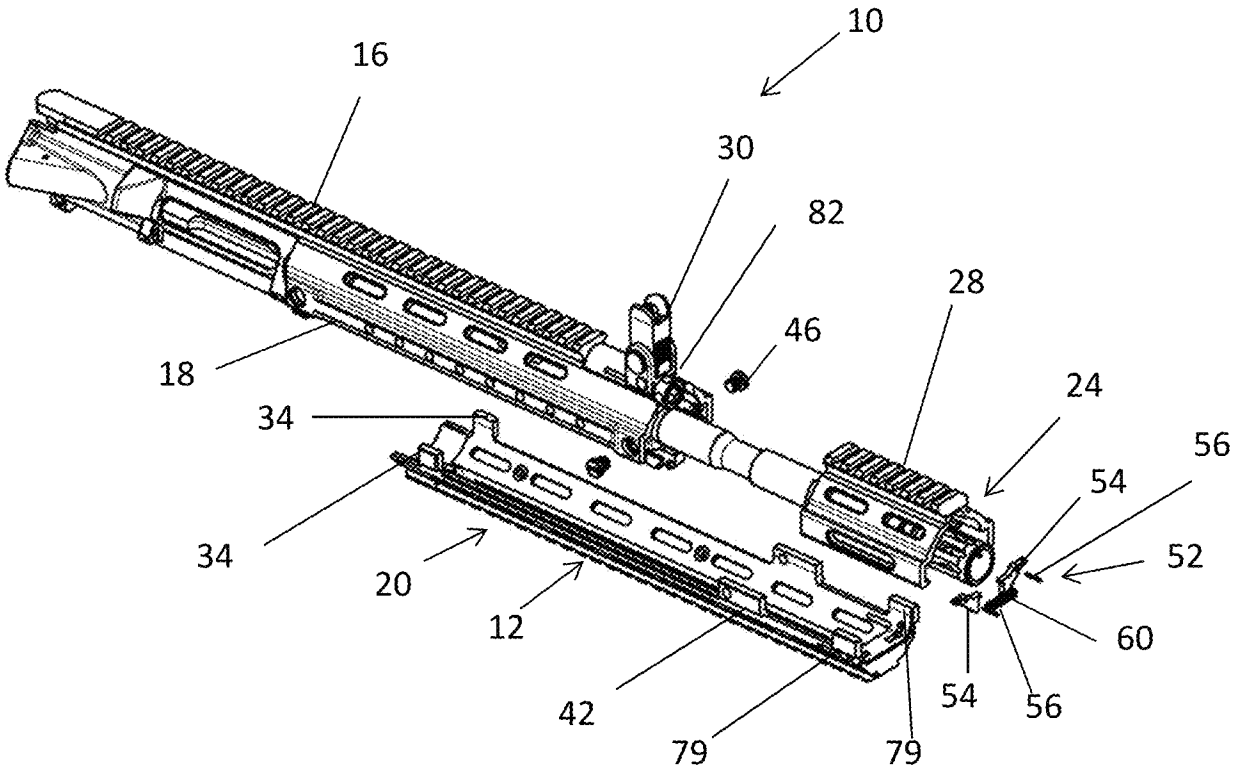
FIG. 7B is an exploded perspective view of the FIG. 7A embodiment.

Referring now to FIGS. 7A and 7B an alternative embodiment is illustrated. Here the upper portion 24 is configured without opening 80 such that upper rail 28 of the upper portion 24 extends all the way to the sight 30. This configuration is particularly useful for gas operated firearm systems that do not require access to the forward end of the gas block 82.

Figure 8A:
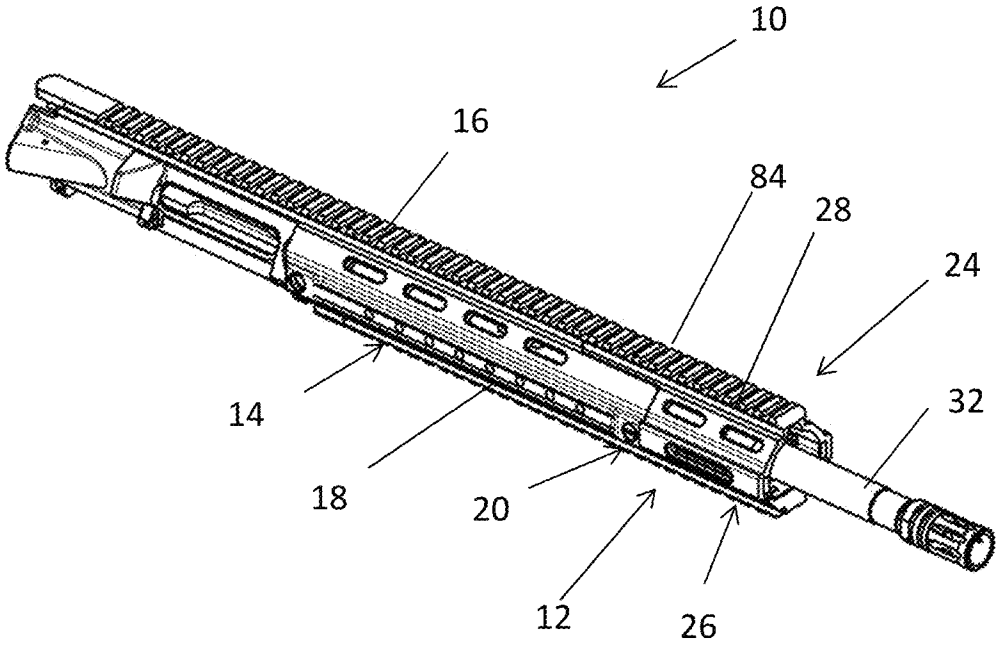
FIG. 8A is a perspective view of an upper receiver and modular rail assembly in accordance with another alternative embodiment.
Figure 8B:
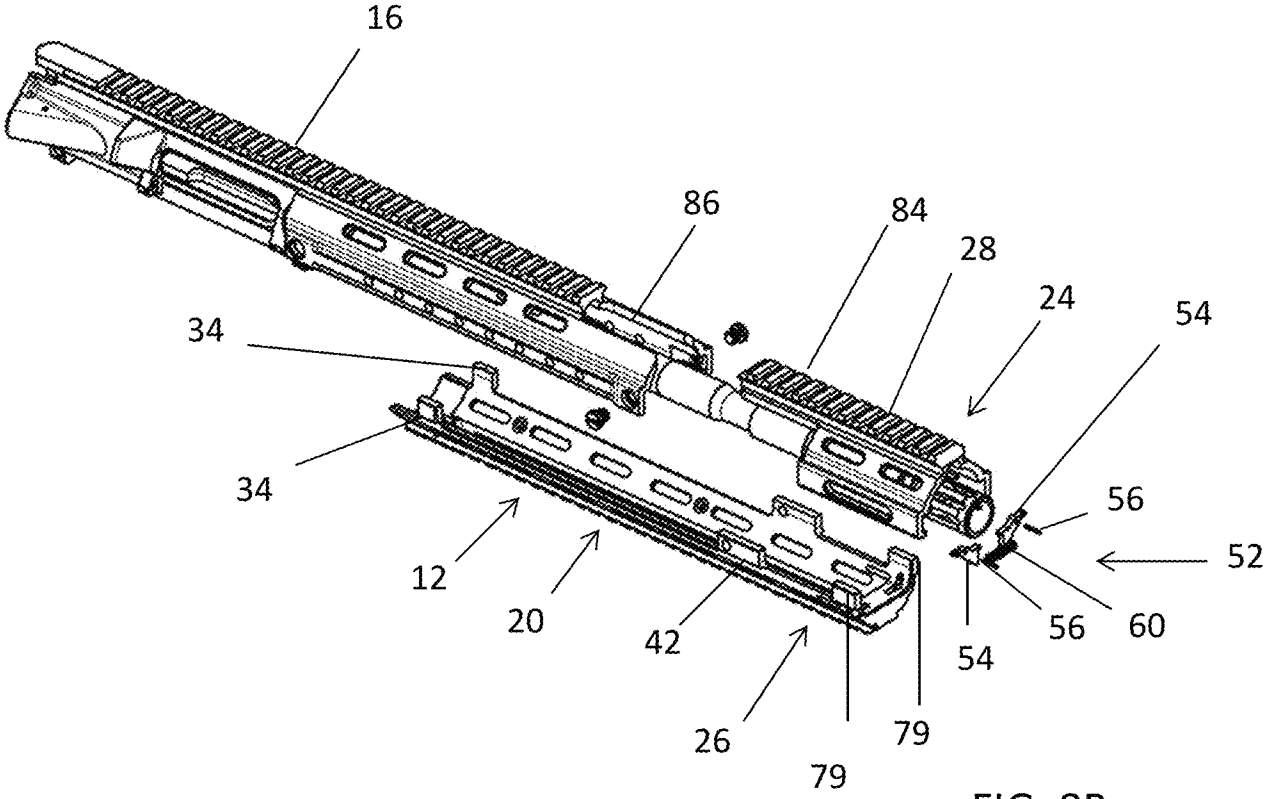
FIG. 8B is an exploded perspective view of the FIG. 8A embodiment.

Referring now to FIGS. 8A and 8B yet another alternative embodiment is illustrated. Here the upper receiver 10 is configured without sight 30 and upper portion 24 is configured to have an extended upper rail portion 84 that extends from the upper portion 24 into an opening 86 of the upper receiver 10 such that when the upper portion 24 is secured to the forward portion 26 of the bottom portion 20 top rail 16 of the upper receiver 10 is continuous with the extended upper rail portion 84 as well as the upper rail 28 of the upper portion 24. See at least FIG. 8A.

Figure 9A:
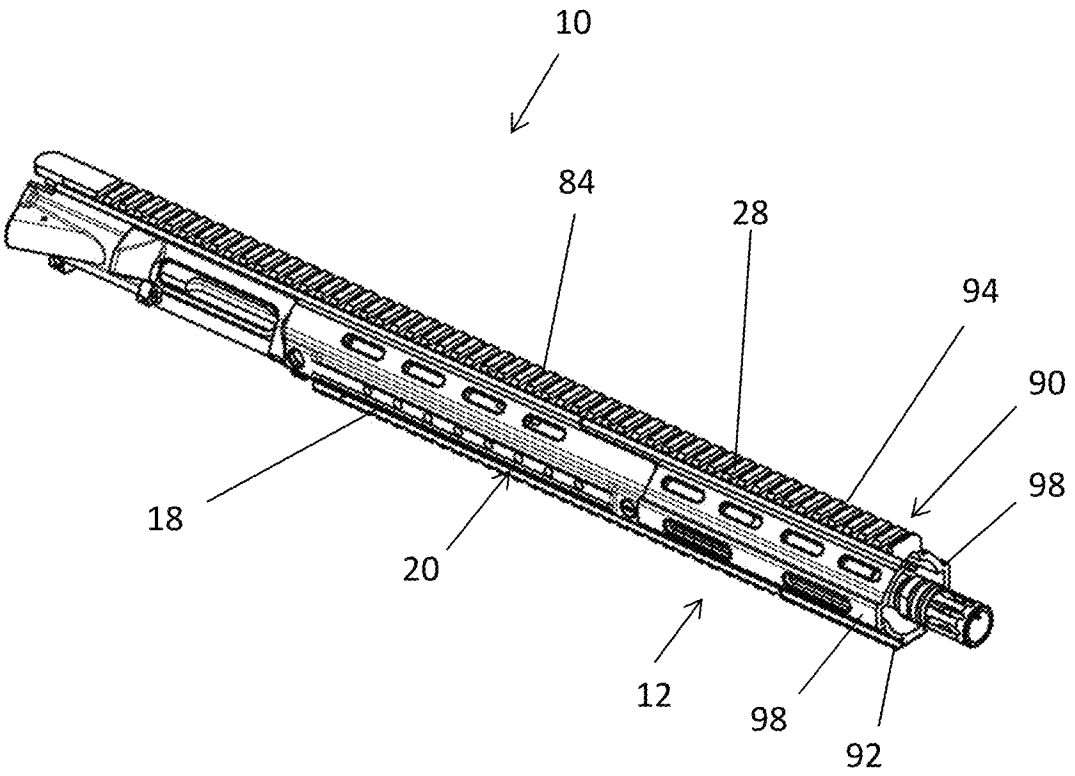
FIG. 9A is a perspective view of an upper receiver and modular rail assembly in accordance with yet another alternative embodiment.
Figure 9B:
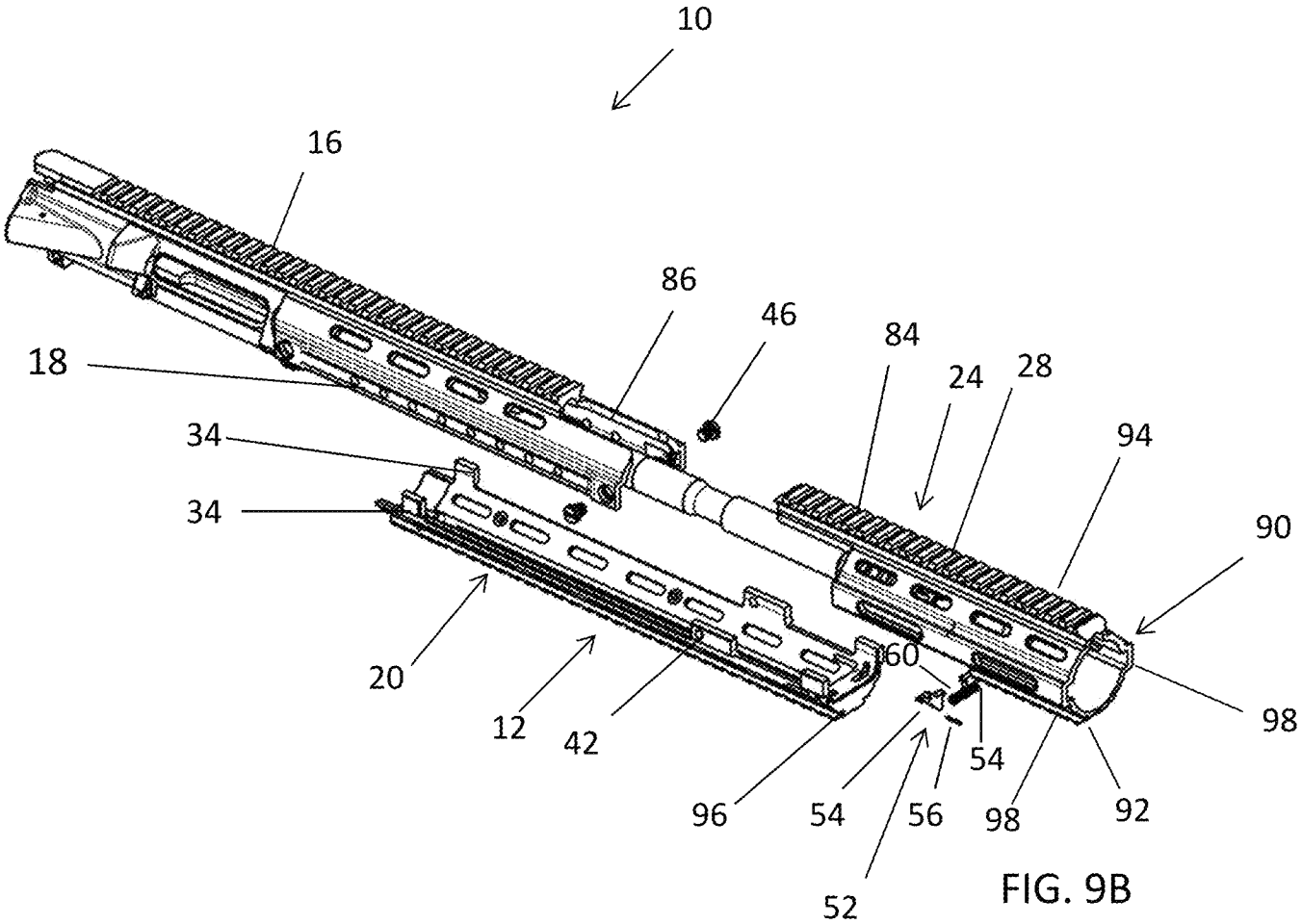
FIG. 9B is an exploded perspective view of the FIG. 9A embodiment.
Figure 9C:
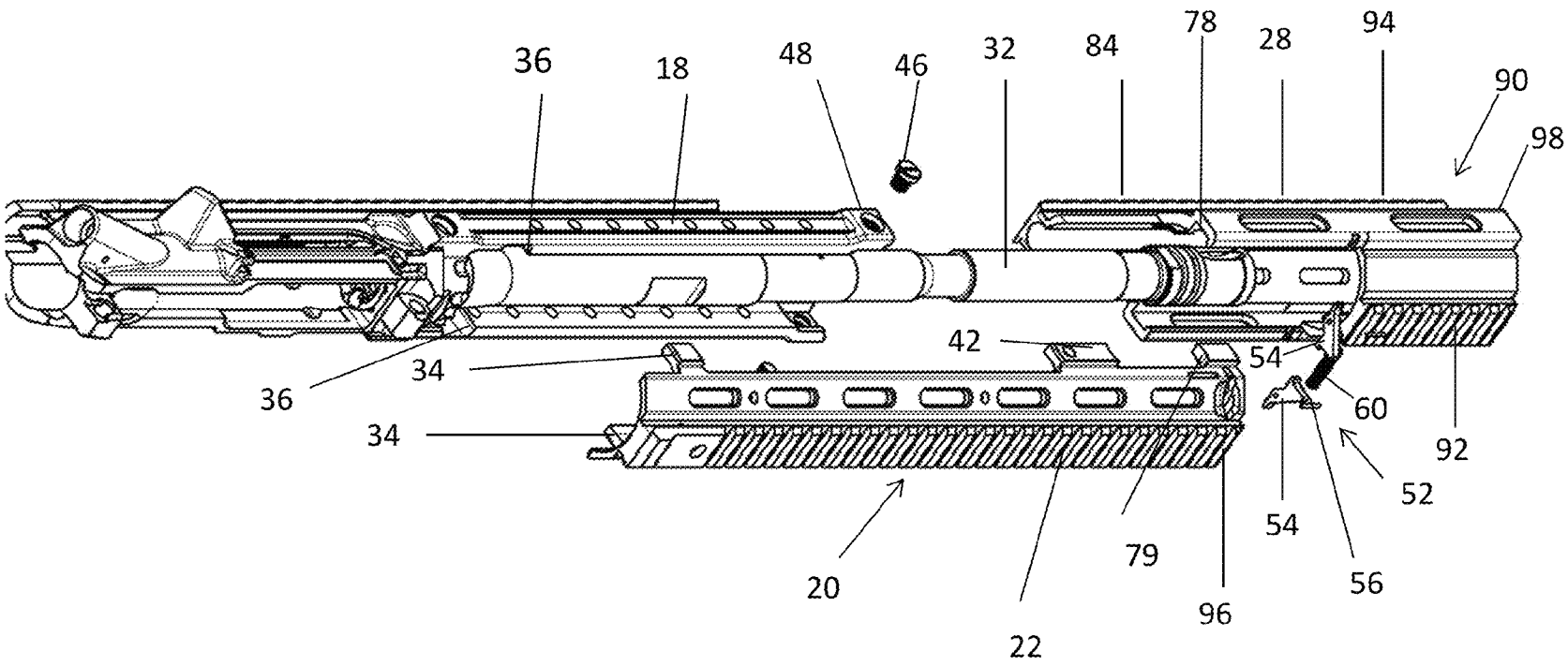
FIG. 9C is another exploded perspective view of the FIG. 9A embodiment.

Referring now to FIGS. 9A-9C yet another alternative embodiment is illustrated. Here the upper receiver 10 is once again configured without sight 30 and upper portion 24 is configured to have an extended upper rail portion 84 that extends from the upper portion 24 into an opening 86 of the upper receiver 10 such that when the upper portion 24 is secured to the forward portion 26 of the bottom portion 20 top rail 16 of the upper receiver 10 is continuous with the extended upper rail portion 84 as well as the upper rail 28 of the upper portion 24. See at least FIG. 9A. However and in this embodiment, the forward portion 24 is further configured to have a forward extension or portion 90 that comprises a bottom rail or bottom portion 92 and a forward rail portion 94 that extends forward from a distal end 96 of the bottom portion 20. Alternatively, the forward extension may be configured without a bottom rail and/or the upper rail portions.

In this configuration, a forward portion 24 when secured to the bottom portion 20 and the upper receiver 10 provides yet a further forward extension of the hand guard and rail system of the upper receiver 10 via the modular rail system 12. As illustrated, the forward portion has an integrally formed forward extension 90 that comprises both the bottom rail 92, the upper forward rail portion 94 as well as side sections 98.

As illustrated in at least FIG. 9A this forward extension 90 of the forward portion 24 causes the hand guard and rail system of the upper receiver to extend forward to accommodate longer rifle configurations and/or cover the forward distal end of the barrel 32 of the firearm. This extension feature is provided by the modular rail system 12.

As illustrated in the FIGS., modular rail system 12 can provide various configurations to the upper receiver 10 through the use of interchangeable forward portions 24 each of which have varying configurations to accommodate various firearm configurations as well as user preferences.

In any of the aforementioned embodiments, the side rail portions 18 may be configured as those illustrated in U.S. Provisional Patent Application Ser. No. 61/481,697, filed May 2, 2011 and U.S. Non-Provisional patent application Ser. No. 13/462,346 filed May 2, 2012 the contents each of which are incorporated herein by reference thereto. In addition, and in any of the aforementioned embodiments including the side rail portions 18 mentioned above, the sight 30 may be configured as the locking sight illustrated in U.S. Provisional Patent Application Ser. No. 61/498,226, filed Jun. 17, 2011, U.S. Provisional Patent Application Ser. No. 61/594,075, filed Feb. 2, 2012 and U.S. Non-Provisional patent application Ser. No. 13/524,591, filed Jun. 15, 2012 and U.S. Non-Provisional patent application Ser. No. 13/524,577, filed Jun. 15, 2012 the contents each of which are incorporated herein by reference thereto.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the present application.

What is claimed is:

1. A modular rail system for an upper receiver of a firearm, comprising:

a bottom portion configured to be removably secured to the upper receiver, wherein the bottom portion has an integrally formed bottom rail and a forward portion located forward of a top rail of the upper receiver;

an upper rail extension configured to be removably secured to the forward portion of the bottom portion, wherein the upper rail extension has a rail portion and a pair of side members defining an opening proximate to an end of the rail portion of the upper rail extension, wherein the opening of the upper rail extension is located at a distal end of the rail portion of the upper rail extension and directly adjacent to an end of the upper receiver when the upper rail extension is secured to the bottom portion; and a release mechanism for releasably securing the upper rail extension to the forward portion of the bottom portion.

2. The modular rail system as in claim 1, wherein the release mechanism further comprises a pair of members pivotally mounted to the bottom portion wherein each of the pair of members have a portion configured to be received within a feature of the upper rail extension.

3. The modular rail system as in claim 1, wherein the opening of the upper rail extension is located forward of a sight opening in the upper receiver when the upper portion is secured to the bottom portion.

4. The modular rail system as in claim 1, wherein the pair of side members secure the upper rail extension to the bottom portion.

5. The modular rail system as in claim 1, wherein the pair of side members abut a forward end of the upper receiver when the upper rail extension is secured to the bottom portion.

6. An upper receiver for a weapon, comprising:

a bottom portion configured to be removably secured to the upper receiver, wherein the bottom portion has a forward portion located forward of a top rail of the upper receiver;

an upper portion configured to be removably secured to the forward portion of the bottom portion, wherein the upper portion has a rail portion and a pair of side members defining an opening proximate to an end of the rail portion of the upper portion, wherein the opening of the upper portion is located at a distal end of the rail portion of the upper portion and directly adjacent to an end of the upper receiver when the upper portion is secured to the bottom portion; and a release mechanism for releasably securing the upper portion to the forward portion of the bottom portion.

7. The upper receiver as in claim 6, wherein the opening of the upper portion is located forward of a sight opening in the upper receiver when the upper portion is secured to the bottom portion.

8. The upper receiver as in claim 6, wherein the pair of side members secure the upper portion to the bottom portion.

9. The upper receiver as in claim 6, wherein the pair of side members abut a forward end of the upper receiver when the upper portion is secured to the bottom portion.

10. A firearm, comprising:

an upper receiver;

a bottom portion configured to be removably secured to the upper receiver, wherein the bottom portion has a forward portion located forward of a top rail of the upper receiver;

an upper portion configured to be removably secured to the forward portion of the bottom portion, wherein the upper portion has a rail portion and a pair of side members defining an opening proximate to an end of the rail portion of the upper portion, wherein the opening of the upper portion is located at a distal end of the rail portion of the upper portion and directly adjacent to an end of the upper receiver when the upper portion is secured to the bottom portion; and a release mechanism for releasably securing the upper portion to the forward portion of the bottom portion.

11. The firearm as in claim 10, wherein the rail portion of the upper portion is integrally formed with the upper portion and wherein the bottom portion further comprises an integrally formed bottom rail portion.

12. The firearm as in claim 10, wherein the opening of the upper portion is located forward of a sight opening in the upper receiver when the upper portion is secured to the bottom portion.

13. The firearm as in claim 10, wherein the pair of side members secure the upper portion to the bottom portion.

14. The firearm as in claim 10, wherein the pair of side members abut a forward end of the upper receiver when the upper portion is secured to the bottom portion.

15. The firearm as in claim 10, wherein the opening of the upper portion is located forward of a sight opening in the upper receiver when the upper portion is secured to the bottom portion and wherein a gas block of the firearm is located in the sight opening and the opening of the upper portion is configured to allow for removal of a piston from a forward end of the gas block when the upper portion is secured to the bottom portion.

16. A method of securing a rail extension to an upper receiver of a weapon, comprising:

removably securing a bottom portion to the upper receiver, wherein the bottom portion has a forward portion located forward of a top rail of the upper receiver when the bottom portion is secured to the upper receiver; and removably securing an upper portion to the forward portion of the bottom portion, wherein the upper portion extends forward an upper rail of the upper receiver and wherein the upper portion has a rail portion and a pair of side members defining an opening proximate to an end of the rail portion of the upper portion, wherein the opening of the upper portion is located at a distal end of the rail portion of the upper portion and directly adjacent to an end of the upper receiver when the upper portion is secured to the bottom portion.

17. The weapon as in claim 16, wherein the opening of the upper portion is located forward of a sight opening in the upper receiver when the upper portion is secured to the bottom portion.

18. The weapon as in claim 16, wherein the pair of side members secure the upper portion to the bottom portion.

19. The weapon as in claim 16, wherein the pair of side members abut a forward end of the upper receiver when the upper portion is secured to the bottom portion.

20. The weapon as in claim 16, wherein the opening of the upper portion is located forward of a sight opening in the upper receiver when the upper portion is secured to the bottom portion and wherein a gas block of the firearm is located in the sight opening and the opening of the upper portion is configured to allow for removal of a piston from a forward end of the gas block when the upper portion is secured to the bottom portion.

* * * * *